United States Patent [19]

Muyskens

[11] Patent Number: 4,811,840

[45] Date of Patent: Mar. 14, 1989

[54] APPLIANCE SHIPPING CONTAINER WITH INTEGRAL CORNER POSTS

[75] Inventor: David B. Muyskens, Rockford, Mich.

[73] Assignee: White Consolidated Industries, Inc., Cleveland, Ohio

[21] Appl. No.: 191,615

[22] Filed: May 9, 1988

[51] Int. Cl.[4] ..... B65D 25/22; B65D 25/26; B65D 25/54

[52] U.S. Cl. ..... 206/320; 206/45.33; 206/497

[58] Field of Search ..... 206/320, 45.33, 497, 206/453, 597

[56] References Cited

U.S. PATENT DOCUMENTS

| | | | |
|---|---|---|---|
| 2,290,217 | 11/1960 | Nason | 206/320 |
| 2,474,968 | 7/1949 | Beach, Jr. | 206/320 |
| 2,779,463 | 1/1957 | Zimmerman | 206/320 |
| 2,797,800 | 7/1957 | Sider | 206/320 |
| 3,163,290 | 12/1964 | Shive | 206/320 X |
| 3,616,986 | 11/1971 | Wolfe et al. . | |
| 3,675,765 | 7/1972 | Melsek . | |
| 3,734,389 | 5/1973 | Brown . | |
| 3,835,986 | 9/1974 | Le Beau | 206/320 |
| 3,891,086 | 6/1975 | Isaacs | 206/320 |
| 3,918,580 | 11/1975 | Poggiali | 206/320 |
| 3,982,682 | 9/1976 | Fremion | 206/320 X |
| 3,999,658 | 12/1976 | Anderson | 206/320 |
| 4,186,834 | 2/1980 | Krack | 206/320 |
| 4,226,327 | 10/1980 | Ballard | 206/320 |
| 4,248,350 | 2/1981 | Gilbert | 206/320 X |
| 4,429,791 | 2/1984 | Ruppel et al. | 206/453 X |
| 4,483,444 | 11/1984 | Gardner | 206/320 X |
| 4,610,355 | 9/1986 | Maurer | 206/497 X |

*Primary Examiner*—William Price

*Attorney, Agent, or Firm*—Pearne, Gordon, McCoy & Granger

[57] ABSTRACT

A pair of cardboard blanks are each folded and glued to provide opposite sides of an appliance shipping container, each side including a pair of vertical corner posts integrally formed from folded portions of its associated blank. The two sides are fastened at their bottom ends to opposite edges of a rectangular base element supporting an appliance. Flaps at the tops of the two sides are folded to overlap each other, and are glued together to constitute the top of the container. One of the flaps includes an integrally formed handling flange to facilitate lifting and moving of the container. A transparent plastic film is stretch wrapped about the sides to complete the container, the resultant container having four generally transparent sides to allow a substantially full view of the appliance contained therein.

11 Claims, 7 Drawing Sheets

APPLIANCE SHIPPING CONTAINER WITH INTEGRAL CORNER POSTS

BACKGROUND OF THE INVENTION

The present invention relates in general to packaging, and more particularly to a see-through container for shipping a large household appliance such as a refrigerator or the like.

See-through containers or cartons for shipping appliances, such as refrigerators, are known. U.S. Pat. Nos. 3,891,086 and 4,226,327 disclose packages wherein an open sided, cardboard structure surrounding the appliance supports a transparent plastic film wrapped around it. Thus, although the appliance is completely contained within and protected by the resultant container, the appliance can still be readily viewed and inspected via the transparent film. While the two noted prior art packages do provide the advantageous see-through feature, they both require the use of relatively complex, multi-component cardboard structures for containing the appliance and supporting the associated plastic film.

The complexity of the prior art cardboard structures inherently adds to the cost of packaging, and makes more difficult the automation of the packaging process.

It would be desirable to provide a low-cost, see-through appliance container that could be easily adapted to automated packaging. Such an improved container should also provide means to facilitate handling of the container by a forklift truck, as is customary in the appliance shipping business.

SUMMARY OF THE INVENTION

In accordance with the present invention, a low cost appliance shipping container includes a cardboard enclosure surrounding the appliance, the enclosure being formed from at least two cardboard sheets. The enclosure has vertically extending corner posts integrally formed only from folded portions of the cardboard sheets, the corner posts engaging the appliance. The enclosure has open sides resulting from the folding of the corner post providing portions so as to permit viewing of the appliance when surrounded by the cardboard enclosure.

A transparent flexible plastic film is wrapped about the cardboard enclosure wherein the film biases the corner posts towards the appliance to maintain the corner posts in engagement with the appliance thereby maintaining the position of the appliance within the container so as to provide a unitized package.

Preferably, the enclosure includes only two cardboard sheets, each providing a pair of vertically extending corner posts, the resultant enclosure being cubicle and having four vertically extending, integrally formed corner posts. The shipping carton can include a rectangular base member for supporting the appliance wherein the two cardboard sheets, each having a pair of integrally formed corner posts, are fastened at their bottom ends to opposite edges of the rectangular base. Preferably, the cardboard sheets include flap portions at their upper ends wherein the flap portion of one sheet can be folded to overlap at least a portion of the other folded flap portion wherein the overlapped flap portions constitute the top of the carton. One of the flap portions can include an integral folded portion constituting a handling flange to facilitate lifting and moving of the carton with the appliance contained therein.

The present invention thus provides a low cost see-through appliance container that can be easily adapted to automated packaging.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENTS

Figure 1:
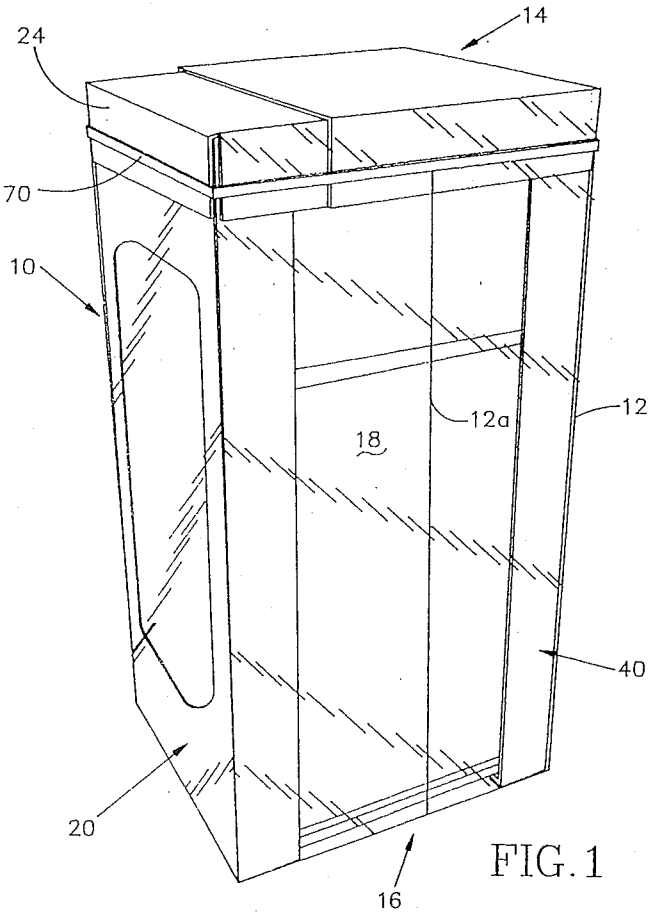
FIG. 1 is a front perspective view of an appliance shipping container with an appliance contained therein in accordance with the present invention.

Turning to FIG. 1 of the drawings, an appliance shipping carton or container 10 in accordance with the present invention holds and completely encloses a large household appliance in the illustrated form of a refrigerator 18. The refrigerator 18 can be viewed within the container 10 via a transparent flexible plastic film 12 stretch wrapped about the four vertically extending sides of the container 10 as illustrated. As will become more apparent, the container 10 has generally open sides to permit viewing of the four sides of the refrigerator 18 via the transparent plastic film 12. The container 10, with its plastic film 12 extending generally all the way from its bottom to its top to its bottom, includes a top end 14 and a bottom end 16.

The container includes as major components a first or left side panel 20 formed from a single sheet of cardboard material, and a second or right side panel 40 also formed from a single sheet of cardboard material as will be illustrated in greater detail in subsequent drawing figures. A handling flange 24 is integrally formed from a portion of the left side panel 20 and overlaps the plastic film 12 as illustrated. A metal or plastic retaining band 70 is tightly wrapped around the top end of the container 10 and extends over the handling flange 24 to maintain it in position against forces applied by forks from a lift truck that are vertically slid underneath the flange 24 to permit lifting of the container 10 in a conventional manner known in the art. It should be noted that the film 12, as will be subsequently illustrated, is formed from two sheets that are thermally seamed together as illustrated by a vertical seam 12*a*, a complementary vertical seam along the back side of the container 10 to be subsequently illustrated.

As will become apparent, a completed shipping container 10, with the appliance 18 contained therein as illustrated in FIG. 1, provides a unitized package permitting a generally full four sided view of the appliance 18. Because the appliance 18 can be viewed through the four open sides of the shipping container 10 via the transparent plastic film 12, advertising and other promotional information fastened to the sides of the refrigerator can be easily viewed. Also, the visibility of the appliance allows for inspection to detect any damage that may occur during shipping, such visual inspection being performed without requiring the opening or removal of the container 10.

Figure 2:
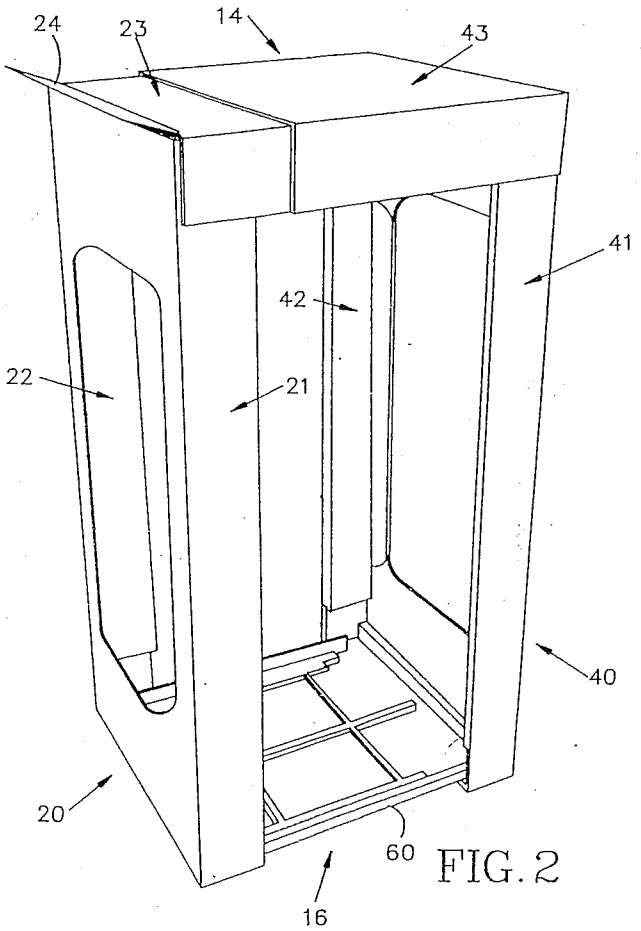
FIG. 2 is a perspective view of the appliance shipping container with the appliance removed therefrom, and with other elements of the shipping container deleted for purposes of illustration.

Turning to FIG. 2, the shipping carton 10 is illustrated without an appliance contained therein, and without the plastic film 12 or retaining band 70 discussed earlier with regard to FIG. 1. The shipping carton in accordance with the present invention can be seen to include at its bottom end 16, a rectangular base member 60 preferably formed as a one piece molded element of styrofoam type plastic for example. The left side panel 20, at its bottom end, fits over and is fastened to a left edge of the base member 60, while in a similar fashion the right side panel 40, at its bottom end, fits over and is fastened to an opposite or right edge of the base member 60 as illustrated.

The two side panels 20, 40 vertically extend upwardly in parallel spaced relationship from each other, each having a central window-like aperture as illustrated. The left side panel 20 includes as an integral portion thereof, a left front corner post 21 and a left rear corner post 22. In a similar fashion, the right side panel 40 includes as an integral portion thereof, a right front corner post 41 and a right rear corner post 42.

At the top end of the left side panel 20, the handling flange 24 is provided as well as a top flap portion 23. The right side panel 40 includes at its upper end a top flap portion 43. It can be seen that the top flap portions 23, 43 are folded to overlap each other and are fastened together by for example thermal adhesive glue seams so as to provide the top 14 of the shipping carton. It can also be seen that the side panels 20, 40 in combination with the base member 60 provide a generally cubicle cardboard enclosure or structure that surrounds the appliance contained therein.

With the appliance contained within the assembly illustrated in FIG. 2, and with the handling flap 24 extending generally horizontally is illustrated, automated machinery can stretch wrap the cardboard enclosure of FIG. 2 with the film 12 (see FIG. 1) extending completely from the bottom to the top of the vertical extent of the four sides. When the wrapping operation is completed, the handling flange 24 is folded downwardly to its position as illustrated in FIG. 1 and the retaining band 70 is applied resulting in the unitized package of FIG. 1 as discussed.

Figure 3:
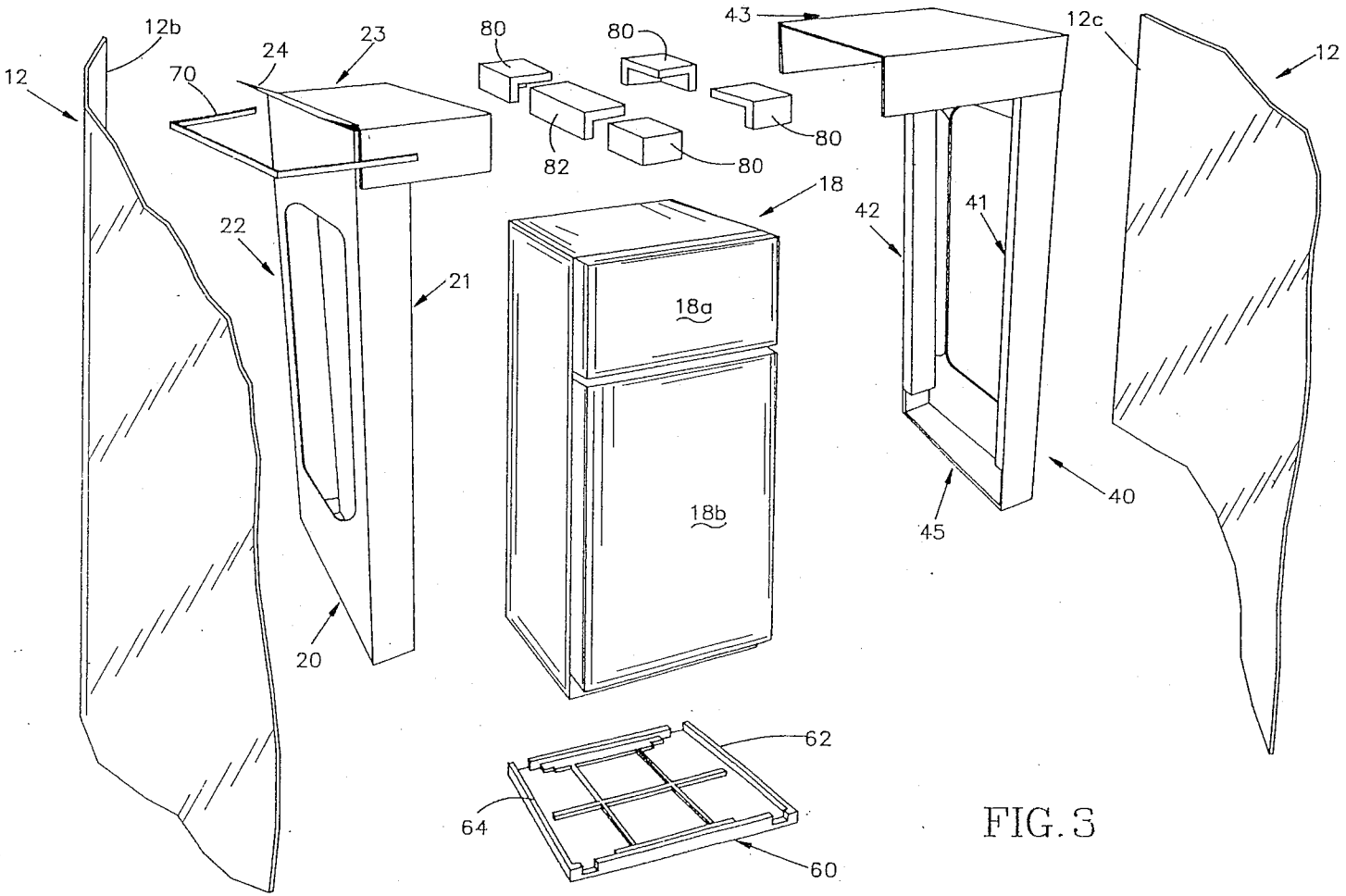
FIG. 3 is an exploded perspective view of the appliance shipping container of FIG. 1 with portions cut away for illustration purposes.

Turning to FIG. 3, the components of the shipping container 10 with the appliance contained therein so as to form a unitized package is more fully illustrated.

It can be seen that the right side panel 40, formed from a single sheet of cardboard as will be subsequently illustrated, includes the vertical pair of corner posts 41, 42 and the top flap portion 43. At its lower end the side panel 40 provides a pocket 45 that is fitted over and glued or otherwise fastened to a right side edge 62 of the base member 60. In a similar fashion, the lower end of the left side panel 20 includes a pocket that is fitted over and glued to a left side edge 64 of the base member 60 supporting the weight of the refrigerator 18.

In a typical fashion, the refrigerator 18 can be seen to include an freezer compartment door 18*a* and a larger refrigerator compartment door 18*b*. The top four corners of the refrigerator 18*b* receive four corner protectors 80 formed from, for example, molded styrofoam plastic. Also, the leftward top edge of the refrigerator 18 receives an edge protector 82 which is positioned between the refrigerator 18 and lifting forks inserted under the handling flange 24 as discussed earlier, so as to protect the refrigerator from damage by the handling forks during movement of the packaged refrigerator 18. With the protectors 80, 82 in position on the refrigerator 18, and with the refrigerator positioned on the base member 60, the side panels 20, 40 are positioned against the left and right sides of the refrigerator 18 and are fastened at their lower ends to the base member 60 as discussed earlier. The top flap portions 23, 43 overlap each other and are glued together. The transparent plastic film 12, shown as being comprised of two sheets, is then stretch wrapped around the side panels 20, 40, the edges 12*b*, 12*c* positioned at the rear of the refrigerator 18 being thermally sealed together to provide a rear vertical seam similar to the front seam 12*a* illustrated at FIG. 1. Thus, the transparent film 12 formed, from two sheets of thermoplastic material, has a front vertical seam and an opposed rear vertical seam formed by conventional heat seaming means.

After the transparent film 12 is applied, the retaining band 70 is wrapped and tensioned around the top end of the shipping carton to hold the handling flange 24 in its vertical position as illustrated in FIG. 1, and to also add to the overall strength and integrity of the top end of the shipping container which bears most of the handling forces when the shipping container with the appliance contained therein is moved from location to location.

Figure 4:
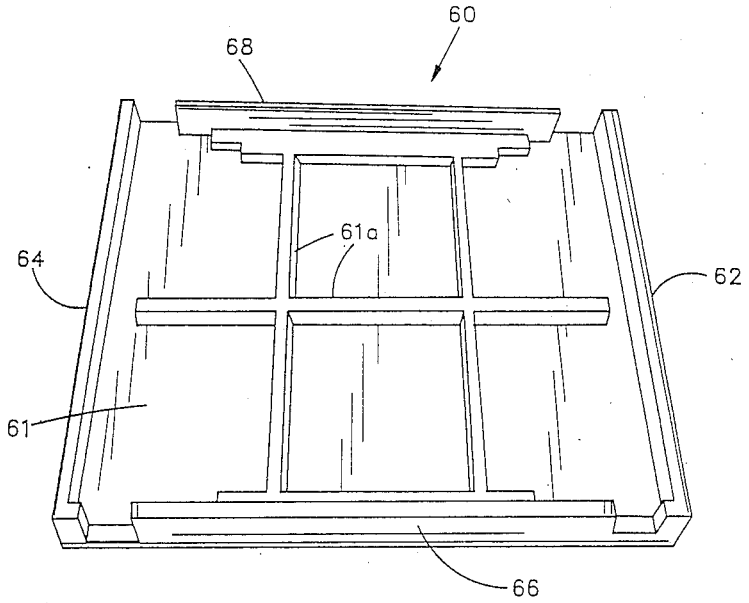
FIG. 4 is the top perspective view of a base member used to support the appliance contained within the shipping container.

With reference to FIG. 4, the base member 60 is most clearly illustrated and can be seen to include a central portion which is generally rectangular and conforms to the rectangular bottom of the appliance it supports. A central portion 61 can include a plurality of reinforcing or strengthening ribs 61*a* as illustrated. In addition to the right and left edges 62, 64, the base member 60 also includes a raised front edge 66 and a raised rear edge 68, the edges 66, 68 being discontinuous at their ends to provide clearance for wheels or supports located at the lower four corners of the appliance supported thereon. Preferably, the base member 60 is formed as a one piece molded unit from styrofoam plastic as noted earlier, however it is clearly contemplated that other configurations of base members could be utilized either of the unitary or multi-component type without departing from the present invention.

Figure 5A:
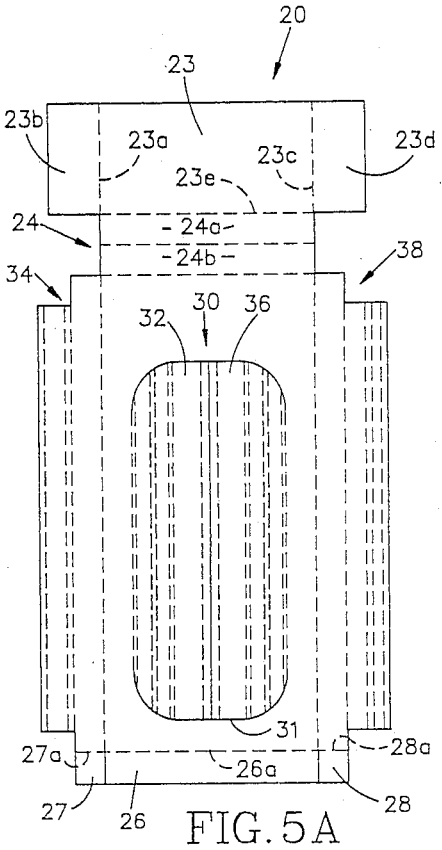
FIGS. 5A–5E illustrate cardboard sheets or blanks that are folded to provide opposite sides of the appliance containers.
Figure 5B:
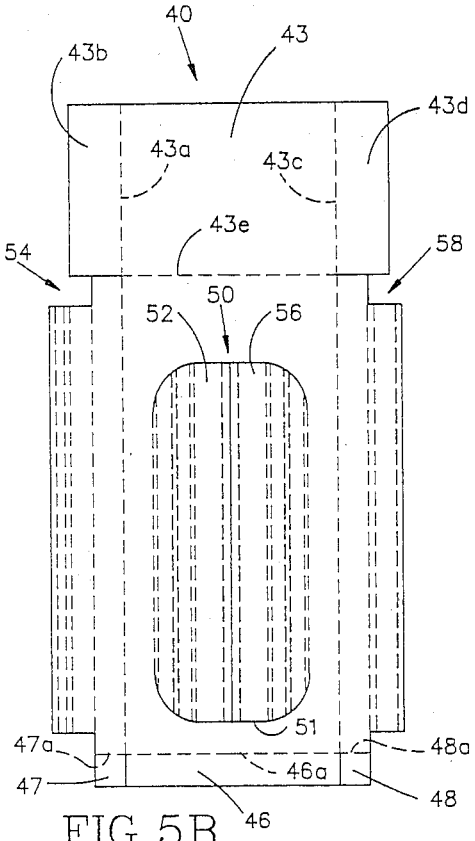

In further accordance with the present invention, FIGS. 5A through 5E illustrate the left and right side panels 20, 40 which are major components of the shipping container. It can be seen that the side panels 20, 40 are somewhat similar in dimension, each being constituted by a generally rectangular, single sheet of cardboard material or blanks, preferably of the single ply corrugated type. In both FIGS. 5A and 5B, fold lines are illustrated by dash lines, while cut lines through the cardboard blanks are illustrated by dark solid lines. The main difference between the left side panel 20 and the right side panel 40, is that the left side panel 20 includes at its upper end a portion for forming the handling flange 24. With further reference to FIGS. 5A and 5B, it can be seen that the overall width and length of the cardboard blanks are generally the same so that standard size cardboard can be utilized for both sides 20, 40. With particular reference to FIG. 5A, the left side panel 20 includes at its upper end, the top flap portion 23 having a fold line **23*a* defining a left end 23*b* and a fold line 23*c* defining a right end 23*d*. When in an assembled position, as illustrated in FIGS. 1–3, the top flap 23 is folded into a horizontal position with its ends 23*b* and 23*d* folded into downwardly extending vertical positions so as to provide half of the top of the carton. Also included as a part in the side panel 20 is a handling flange 24 which includes two halves 24*a* and 24*b* as defined by the central fold line separating the two halves as illustrated. The handling flange 24 is provided by folding over of the two halves 24*a* and 24*b*** (also see FIG. 3).

At the lower end of the left side panel 20, a bottom flap 26 defined by a fold line **26*a* has associated with it a left end 27 defined by fold line 27*a* and a right end 28 defined by fold line 28*a*. Folding of the flap 26 and its associated ends 27, 28 will provide a pocket at the lower end of the side panel 20, for receipt of the associated edge 64 of the base member 60** as illustrated and discussed earlier with regard to FIG. 3.

With further reference to FIG. 5B, in a generally similar fashion the right side panel 40 includes the top flap portion 43 having fold lines **43*a*, 43*c*, 43*e* that define the top flap portion 43 and its associated left and right edges 43*b*, 43*d* that are folded to provide a portion of the top of the shipping container. Because the side panel 40 does not include a handling flange similar to the handling flange 24 of FIG. 5A, flap portion 43 is longer as compared to the top flap portion 23 of side panel 20 so that, as illustrated most clearly in FIG. 3, it provides a greater portion or extent of the top of the shipping carton. It is the top flap portion 43 that overlaps and is glued to the smaller top flap portion 23 of side panel 20 which provides the handling flange 24**.

The lower end of the cardboard sheet or blank constituting the side panel 40 provides a bottom flap portion 46 having, a left end 47 and a right end 48, as defined by fold lines **46*a*, 47*a*, 48*a*. When the bottom flap portion 46 and its associated ends 47 and 48 are folded into a common horizontal plane, they provide the pocket 45 (see FIG. 3) which receives the associated edge 62 of the base member 60** as discussed earlier.

With reference to the cardboard blanks of both FIGS. 5A and 5B, their lower major portions each include central portions 30, 50 that are defined by I-shaped cuts 31, 51. More specifically, the central portion 30 of the left side panel 20 is divided in half by the I-shaped cut 31 to provide a left half 32 and a right half 36. It can be seen that the left half 32 is provided with a plurality of vertical fold lines as is the right half 36.

Extending from the left edge of the left side panel 20, as illustrated in FIG. 5A. is a left edge portion 34 having a plurality of vertical fold lines. In a similar manner, a right edge portion 38 along the right side of the side panel 20 also includes a plurality of vertical fold lines that are positioned differently from the fold lines of the left edge 34.

With reference to 5B, in a similar fashion, the I-shaped cut 51 defining the central portion 50 of the right side panel 40 divides the central portion 50 into a left half 52 and a right half 56, each of the halves 52, 56 having a plurality of vertical fold lines as illustrated. Associated with the left half 52 of the central portion 50 is a left edge portion 54 also having a plurality of vertical fold lines. A right edge portion 58, having a different set of vertical fold lines, is associated with the right half 56 of the central portion 50.

Figure 5C:
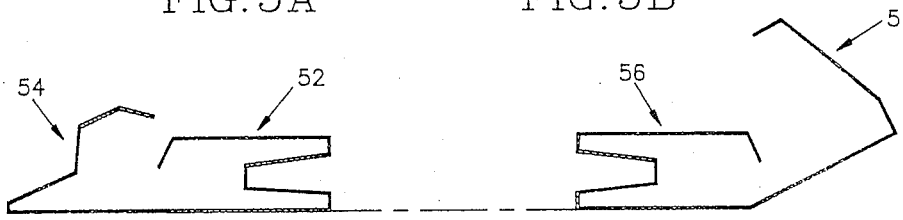
Figure 5D:
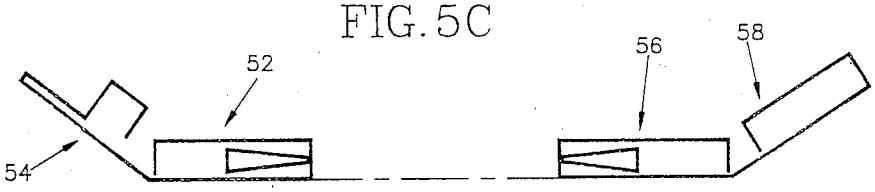
Figure 5E:
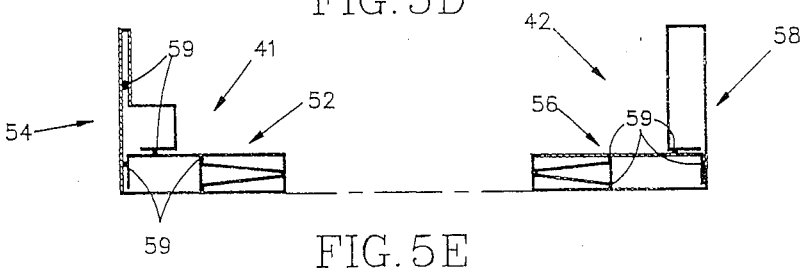

From the above, it can be seen that the side panels 20, 40 are similar as to the provision of central portions 30, 50 and edge portions 34, 38 and 54, 58. In accordance with the present invention, half 32 of central portion 30 is folded toward edge portion 34, while edge portion 34 is folded toward half 32 so as to provide vertical corner post 22 (see FIGS. 2 and 3) as an integral part of side panel 20. In a similar fashion, half 36 is folded toward edge portion 38 (to provide corner post 21), half 52 is folded toward edge portion 54 (to provide corner post 42), and half 56 is folded toward edge portion 58. Thus, four integrally formed vertical corner posts are provided. A clearer understanding of the resultant corner post structure can be derived from FIGS. 5C through 5E which sequentially show the folding of portions 52, 54, 56 and 58 of the right side panel 40. It is to be recognized that the left side panel 20 would be formed in a similar fashion since it is generally identical to the right side panel but for the provision of the handling flange 24 as discussed earlier. With particular reference to FIG. 5C, it can be seen that the left half 52 is folded towards the edge portion 54. In a similar manner, the right half 56 is folded toward the edge portion 58. As shown in FIG. 5D the folding of the halves 52 and 56 has been completed so as to provide front edge protectors for the front and left vertically extending corners of the refrigerator 18. The edge portions 54, 58 have been folded toward halves 52 and 56 to form corner protectors for cushioning the front vertical corners of the appliance in combination with the folded portions 52, 56. In FIG. 5E, the edge portions 54, 58 are shown in their final position relative to their halves 52, 56, a plurality of thermosetting glue seams or stitches 59 being provided as needed to maintain the integrity of the corner post structures 41, 42. It is to be noted that while the glue seams 59 are only illustrated in FIG. E, in an automated process the glue seams, in the preferable form of thermosetting, hot melt adhesive, glue stitches, would be provided on the blanks constituting the side panels 20, 40 at an advantageous point in time during the automated folding thereof.

Figure 6:
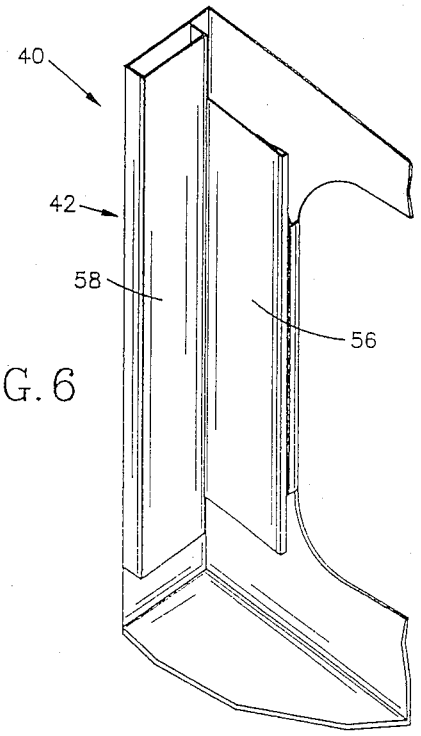
FIG. 6 is a perspective view of the inside of a vertical corner post structure of the shipping container in accordance with the present invention.

With reference to FIG. 6, corner post 42 is shown in its assembled condition wherein half 56 and edge portion 58 have been folded inwardly toward each other wherein half 56 and edge portion 58 are located in the corner of the cartons so as to provide a vertical corner post structure to cushion the appliance container therein. It is also to be noted that edge portion 58 will vertically almost the full height of the side panel 40 while folded half 56 is shorter in length. It can also be seen from FIG. 6 that the associated corner of the appliance will nest within the corner post structure 42 so as to protect it, as is the case with the other corner posts 41, 21 and 22.

Figure 7:
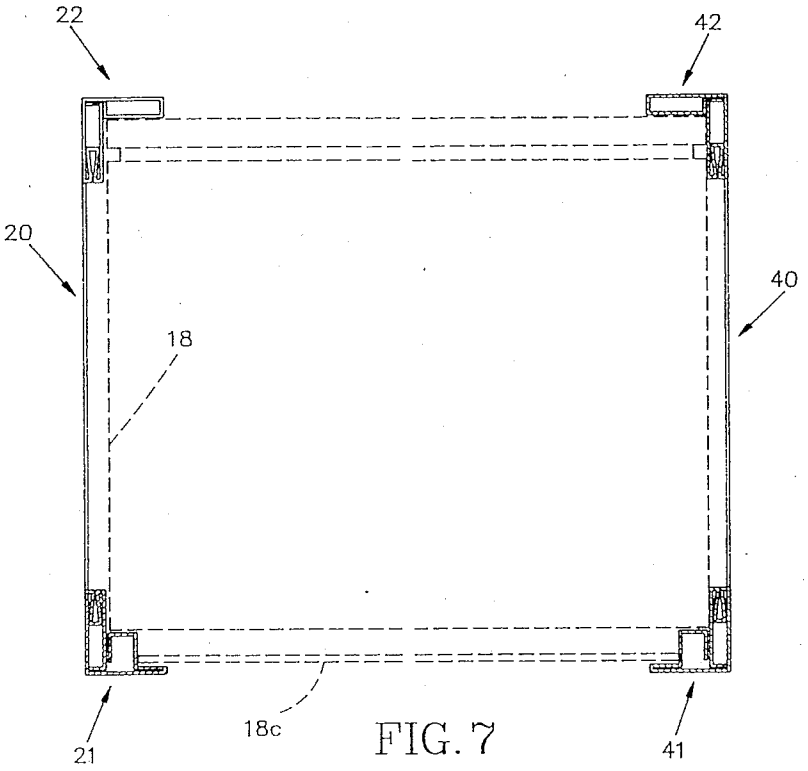
FIG. 7 is a plan view of a horizontal cross section of the shipping container with the appliance contained therein illustrated in phantom.

With reference to FIG. 7, the positioning and cushioning of the refrigerator 18 within the four corner posts 21, 22, 41, 42 is most clearly illustrated. It can be seen that the refrigerator 18 which typically has a condenser element 18c located across its rearward wall is completely contained and cushioned by corner posts 21 and 41. More particularly, the folding of the cardboard portions constituting corner posts 21, 41 provides nesting and support of the condenser 18c and also supports and cushions the rearward vertical corners of the appliance 18. In a similar fashion, it can be seen that corner posts 22, 42 protect, support and cushion the front corners of the refrigerator 18. The refrigerator 18, nested within the corner posts 21, 22, 41, 42, is spaced from the side panels 20, 40 and the plastic film 12 (see FIGS. 1 and 3) when it is wrapped around the sides 20, 40 as discussed earlier. Thus, low impact bumping force applied to the sides of the container 10 (see FIG. 1) will not damage the refrigerator 18 contained therein since it is spaced from the four side walls of the container 10, the top of the appliance and the bottom of the appliance being protected by the container top 14 (see FIG. 1) of the styrofoam members 80, 82 (see FIG. 3) and by the bottom base member 26.

Thus, in accordance with the invention, a container or carton having integrally formed corner posts, and integrally formed top, and an integrally formed handling flange, has four open see through sides that are covered by transparent plastic film wherein the carton including its associated plastic film completely encloses and cushions the appliance to provide a unitized package of minimum components.

It is to recognized that the present invention has applications to appliances other than refrigerator 18, and it is clearly contemplated that the invention could provide containers for washing machines, clothes dryers, ranges and the like. Various changes of the folding in the side panels 20, 40 can be provided for packaging appliances having different dimensions and characteristics. For example, with reference to FIGS. 8A through 8D, and 9A through 9D, difference styles of single sheet cardboard side panels (similar to earlier discussed side panels 20, 40) for packaging an appliance in accordance with the present invention are provided.

Figure 8A:
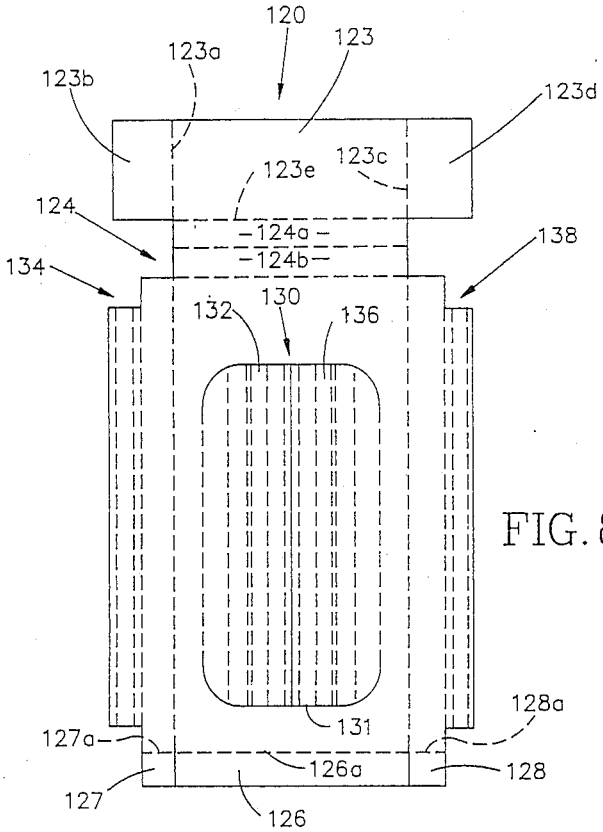
FIGS. 8A–8D and FIGS. 9A–9D illustrate alternative embodiments of cardboard sheets or blanks folded to provide opposite sides of an alternative embodiment of a shipping container in accordance with the present invention.
Figure 8B:
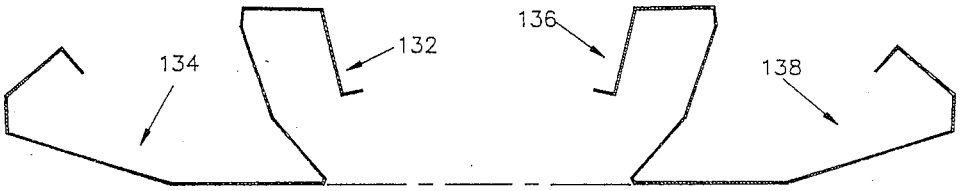
Figure 8C:
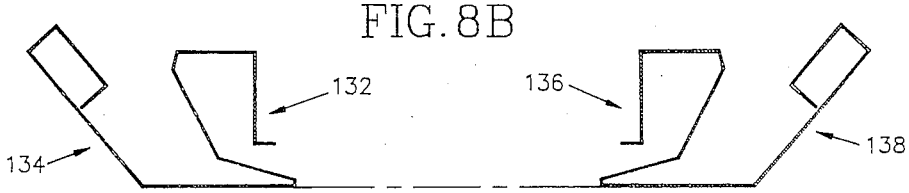
Figure 8D:
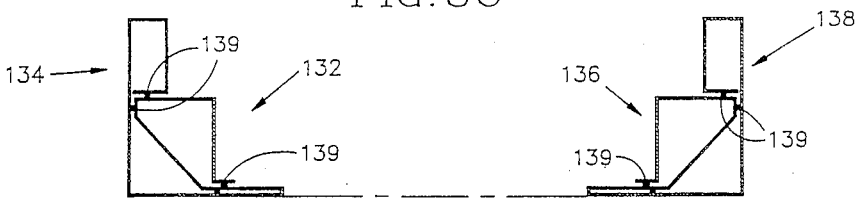

With particular reference to FIGS. 8A through 8D, a rear side panel 120 can be seen to include features similar to the side panel 20 discussed earlier with regard to FIGS. 1 through 7. The side panel 120 includes a top flap portion 123 defined by fold lines 123a, 123c and 123e, the top flap portion 123 thus having associated end portions 123b and 123d. A handling flange 124 is provided by the folding over of portions 124a and 124b. The bottom end of the side panel 120 includes a bottom flap 126 having associated ends 127 and 128 defined by fold lines 126a, 127a, 128a. A central portion 130 of the side panel 120 is divided by an I-shaped cut 131 into a left half 132 and a right half 136, the left half 132 being folded towards an edge portion 134 which in turn is folded towards the left half 132 to provide a corner post structure which will be subsequently illustrated. In a similar manner, the I-shaped cut 131 provides a right half portion 136 folded towards a right edge portion 138 which in turn is folded toward the right half 136 to provide another corner post structure. As illustrated in FIGS. 8B, 8C and 8D the left and right half portions 132 and 136 are folded toward their respective left edge and right edge portions 134, 138 to provide corner post structures that are held together by appropriate glue seams 139.

Figure 9A:
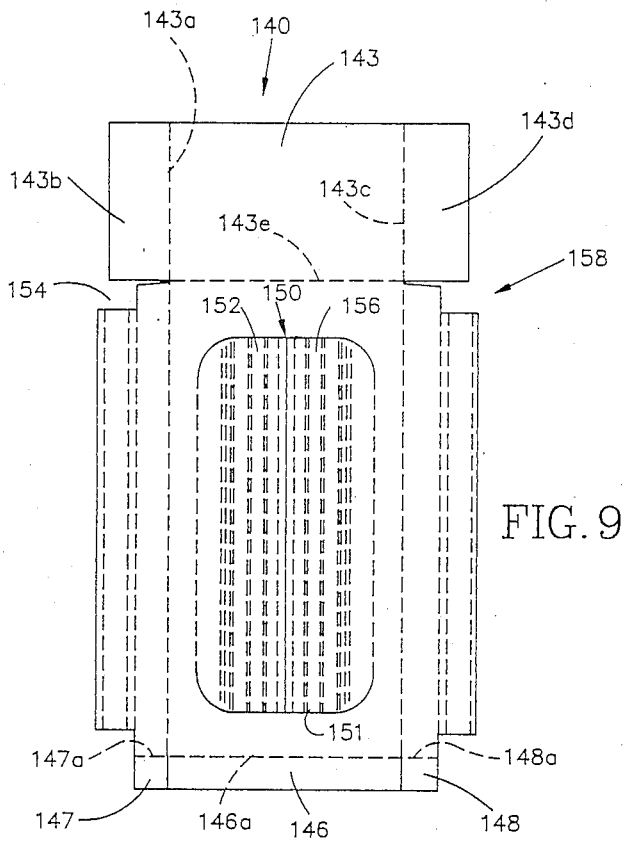
Figure 9B:
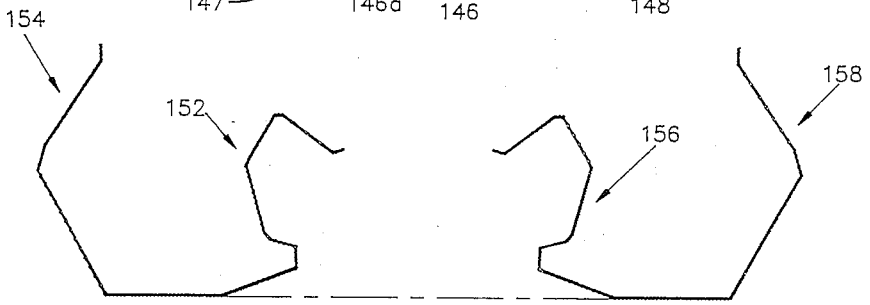
Figure 9C:
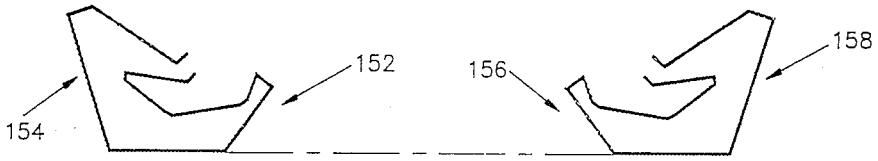
Figure 9D:
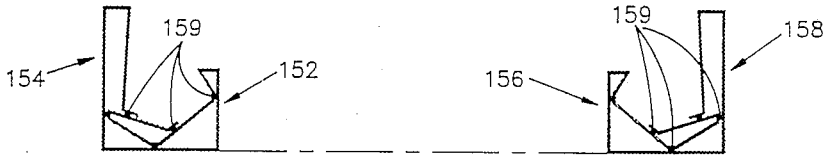

With reference to FIG. 9a, a front side panel 140 (complementing the rear side panel of FIGS. 8A–8D) includes a top flap portion 143 with associated end portions 143b and 143c defined by fold lines 143a, 143c and 143e. At the lower end of the front side panel 140, a bottom flap 146, having associated ends 147 and 148, is defined by fold lines 146a, 147a and 148a. A central portion 150 of the side panel 140 is divided into two halves 152, 156 by an I-shaped cut 151. The left half 152 is associated with a left edge portion 154 of the side 140, while the right half 156 is associated with a right edge portion 158. As shown in FIGS. 9B, 9C and 9D, the cardboard sheet of FIG. 9A, with the various vertical fold lines illustrated, is sequentially folded to provide corner post structures comprised of edge portions 154, 158 and the folded halves 152, 156 as illustrated. A plurality of glue seams 159 are provided to maintain the integrity of the integrally formed corner posts.

From the foregoing discussion of FIGS. 8A through 8D and 9A through 9D, it can be seen, by comparison to the earlier discussions with regard to FIGS. 1 through 7, that panels 120 and 140, although having different fold lines, are from a functional standpoint essentially the same as the earlier discussed side panels 20, 40.

Figure 10:
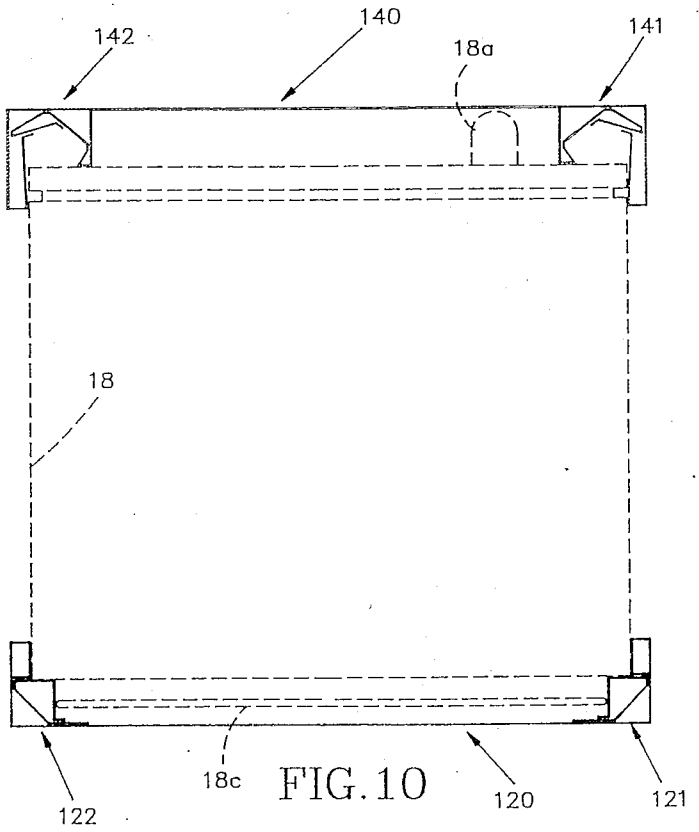
FIG. 10 is a plan view of a horizontal cross section of an alternative embodiment of the shipping container with the refrigerator contained therein illustrated in phantom.

With reference to FIG. 10, it can be seen that the panels 120, 140 instead of constituting left and right side panels, constitute front and rear side panels. More particularly, side panel 120, having integral corner posts 121 and 122, extends across the rear of an associated refrigerator 18, the rear of the refrigerator including a condenser 18C nested within the corner posts 121 and 122. The front side panel 140, having corner posts 141 and 142, is dimensioned to provide clearance for a handle structure 18a of the refrigerator 18. Thus FIG. 7 illustrates side panels 20 and 40 as being left and the right side panels, relative to refrigerator 18, while FIG. 10 illustrates side panels 120 and 140 as being front and rear panels having different dimensions to accommodate the refrigerator 18 having a handle 18a. However, with further regard to FIG. 10, it can be seen that the four integrally formed corner posts 121, 122, 141, 142 each protect and cushion the four vertical corners of the appliance (i.e. refrigerator 18), and serve to space it inwardly from the four outer sides of the container constituted by the side panels 120 and 140 in combination with plastic film 12 that would be wrapped about the side panels.

From all the above, it can be appreciated that a very simple and low cost shipping container having see-through sides has been provided. It can also be appreciated that by stretch wrapping the film 12 about the four integrally formed corner posts, the tensioning of the stretch wrap will apply a force to hold the corner posts in engagement with the corners the appliance contained therein, and that the stretch wrap will inherently increase the bending strength of the corner posts so as to provide for a very rugged unitized appliance package. It will also be recognized that because of the simplicity of the cardboard shipping carton in accordance with the present invention, it can be easily automated to permit high speed, low cost packaging and shipping of appliances.

While the invention has been shown and described with respect to particular embodiments thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A shipping container for an appliance comprising:

a cardboard enclosure surrounding said appliance, said enclosures being formed from at least two cardboard sheets, said enclosure including vertically extending corner posts integrally formed only from folded portions of said cardboard sheets, said corner posts engaging said appliance, said enclosure having open sides resulting from the folding of said portions so as to permit viewing of said appliance when surrounded by said cardboard enclosure; and a transparent, flexible, plastic film wrapped about said cardboard enclosure, said film biasing said corner posts toward said appliance to maintain said corner posts in engagement with said appliance, thereby maintaining the position of said appliance within said container so as to provide a unitized package.

2. A shipping container according to claim 1, wherein said enclosure includes only two of said cardboard sheets, each sheet providing a pair of said vertically extending corner posts, said enclosure being cubical, and having four vertically extending, integrally formed, corner posts.

3. A shipping container according to claim 2, including a rectangular base member for supporting said appliance, said two cardboard sheets, having said pairs of integrally formed corner posts, being fastened at their bottom ends to opposite edges of the rectangular base.

4. A shipping container according to claim 3, wherein said sheets include folded flap portions at their upper ends, the flap portion of one sheet being folded to overlap at least a portion of the other folded flap portion, wherein said overlapped flap portions constitute the top of said carton.

5. A shipping container for an appliance comprising:

first and second, generally rectangular, cardboard sheets, each having a central portion divided into two halves, one half being folded toward one edge of the sheet to constitute at least a portion of a vertical corner post structure, the other half being folded toward the opposite edge of the sheet to constitute at least a portion of another vertical corner post structure;

a rectangular base member for supporting an appliance to be contained within the container, bottom ends of the first and second sheets being fastened to opposite edges of the rectangular base member wherein each of the four folded halves constituting portions of the corner post structures extend vertically upwardly from the four associated corners of the rectangular base member; and a flexible plastic film wrapped about the four vertically extending corner post structures of the container.

6. A shipping container according to claim 5, wherein said plastic film is transparent to permit viewing of said appliance through openings in said sides resulting from folding said halves toward said edges.

7. A shipping container according to claim 5, wherein said sheets include, at their upper ends, flaps that are folded to a horizontal position, one flap at least partially overlapping the other flap, wherein said overlapped flaps constitute a closed top of said container.

8. A container according to claim 7, wherein one of said flaps includes, as an integral folded portion thereof, a handling flange to facilitate lifting and moving of said container with said appliance contained therein.

9. A container according to claim 5, wherein in addition to said folded halves, said corner posts include opposite edge portions of said cardboard sheets folded toward said central portion, each corner post structure including a folded half of said central portion and a folded edge portion of said sheet, said half and its associated edge portion being folded toward each other to form a said corner post, the resultant corner post being integrally formed only from portions of its associated cardboard sheet.

10. A carton according to claim 9, wherein a said folded edge portion is greater in vertical length than its associated folded half of said central portion.

11. A carton according to claim 8, wherein said flexible plastic film does not cover said handling flange.

* * * * *